United States Patent [19]

Williams

[11] 4,232,407

[45] Nov. 11, 1980

[54] BASKET STRAINER AND STOPPER ASSEMBLY FOR SINKS

[75] Inventor: Frank N. Williams, Sandwich, Ill.

[73] Assignee: Bradley Corporation, Menomonee Falls, Wis.

[21] Appl. No.: 21,581

[22] Filed: Mar. 19, 1979

[51] Int. Cl.[3] ..... A47K 1/14; E03C 1/26

[52] U.S. Cl. ..... 4/287; 4/286; 4/290; 4/292

[58] Field of Search ..... 4/286, 287, 289, 295, 4/291, 289, 290, 292

[56] References Cited

U.S. PATENT DOCUMENTS

| | | | |
|---|---|---|---|
| 699,982 | 5/1902 | Seabury | 4/294 |
| 2,544,498 | 3/1951 | Hiertz | 4/287 |
| 3,027,569 | 4/1962 | Lantz et al. | 4/287 |
| 3,525,105 | 8/1970 | Richards | 4/287 |
| 3,588,928 | 6/1971 | Hiertz | 4/287 |
| 4,160,293 | 7/1979 | Niemann | 4/291 |

*Primary Examiner*—Henry K. Artis

[57] ABSTRACT

A basket strainer and stopper assembly for a sink includes a strainer basket, a stopper positioned below the basket strainer for sealing the sink drain opening and an axial stem. The stem has an upper portion which serves as a handle and a lower forked portion which has tines or legs which both support the strainer-stopper assembly in the open drain position and retain it securely in the closed drain position. The legs of the forked portion of the stem are resilient and arcuate and they rest upon a plate extending across the drain opening to support the assembly in the open position. The drain is closed by exerting sufficient downward force on the handle portion of the stem to spring the resilient legs toward each other so they pass through and are retained in a detent opening in the plate. The drain is reopened by pulling upward on the handle with sufficient force to raise the entire assembly and to once again spring the legs toward each other so that they will pass through the detent opening.

3 Claims, 6 Drawing Figures

Fig. 4
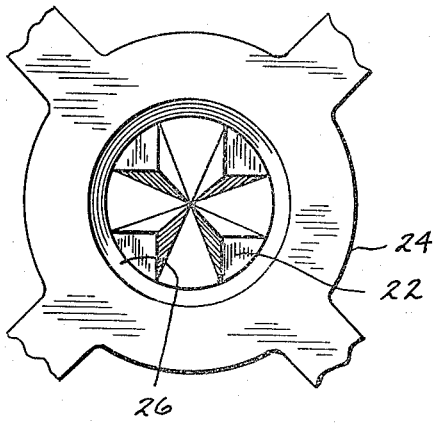
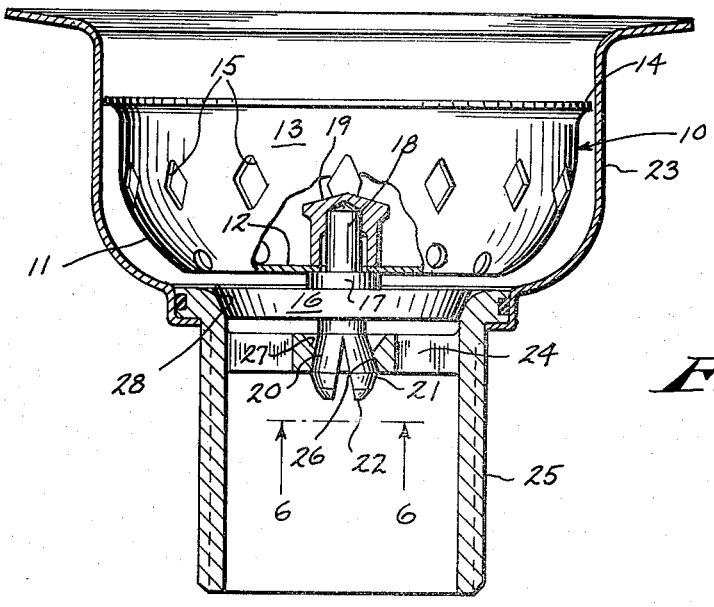
Fig. 5
Fig. 6
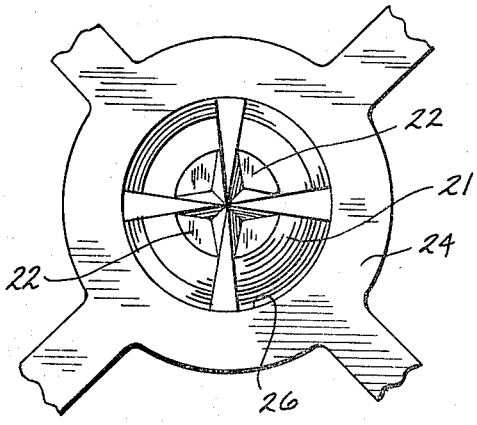

BASKET STRAINER AND STOPPER ASSEMBLY FOR SINKS

The present invention relates generally to stoppers for drains, and more particularly, to basket strainer-stopper assemblies for use in sinks.

BACKGROUND OF THE INVENTION

Basket strainer-stopper assemblies to control the flow of water from sink drains are well known.

The most widely used form of strainer-stopper assemblies have a basket strainer, a control handle and a stopper which is positioned below the strainer and attached to the control handle. The control handle and stopper move independently of the basket strainer. This type of assembly normally requires the alignment and registration of the stopper or the control handle with the drain outlet or with the strainer basket to hold the stopper in an open drain position or retain it in a closed drain position. Usually the alignment or registration of the components must be accomplished in a concealed space out of the sight of the user. As a result, the user often juggles or moves the control handle or the entire unit from one position to another before proper alignment or registration is made.

Another type of strainer-stopper assembly in use has the strainer basket, the control handle and the stopper attached together to form a single unit. The control handle and stopper do not move independent of the strainer basket. In use, the entire assembly is moved from a raised open position which permits water to flow to the sink drain to a lower closed position in which the stopper forms a seal with the drain opening to prevent the escape of water. A distinct advantage of this type of assembly is that the user can see from the position of the assembly if the drain is open or closed. Such an assembly requires a stable means of supporting the entire assembly in the open position against the forces of gravity and the head of water in the sink which tend to move it to the closed position. However, most such support means are unduly complex, difficult to clean and/or fail to provide stable support for the assembly in the open position.

SUMMARY OF THE INVENTION

It is a primary object of the present invention to provide a simple and effective strainer basket and stopper assembly of the type in which the entire assembly moves from an open to a closed position.

It is a further object to provide a strainer basket and stopper assembly which is provided with support means that provide stable support for the assembly in the open drain position and, in addition, securely retain it in the closed drain position.

These objects are obtained by the basket strainer and stopper assembly of the present invention which includes a strainer basket, a stopper for the sink drain opening positioned below the basket and a stem which has an upper portion which serves as a handle and a lower forked portion which supports the entire assembly in the open drain position and retains it securely in a closed drain position. The forked portion of the stem has a plurality of resilient tines or legs. In the open drain position, the tines rest upon a plate extending across the drain opening to support the entire assembly and upon exertion of sufficient downward force on the stem the tines are sprung toward each other and pass through a detent opening in the plate which retain the assembly in the closed drain position. The drain is reopened by pulling upward on the handle to move the entire assembly upward and remove the tines from the detent opening.

In a preferred embodiment, the lower forked portion of the stem has four arcuate shaped resilient tines and a detent opening in the drain plate which is circular. In the open position, the tips of the tines rest on the beveled edge of the detent opening. The application of sufficient downward force on the handle of the stem springs the tines inwardly to permit the forked portion to pass through the detent opening. The assembly is retained with the stopper in sealing relationship with the drain opening by the resilient tines which assume their normal shape after passing through the detent opening.

BRIEF DESCRIPTION OF THE DRAWINGS

FIG. 4 is an enlarged view taken along lines 4—4 of FIG. 3;

FIG. 5 is a sectional view of the strainer and stopper assembly and drain of FIG. 3 in the closed drain position; and FIG. 6 is an enlarged view taken along lines 6—6 of FIG. 4.

DESCRIPTION OF THE PREFERRED EMBODIMENT

Figure 1:
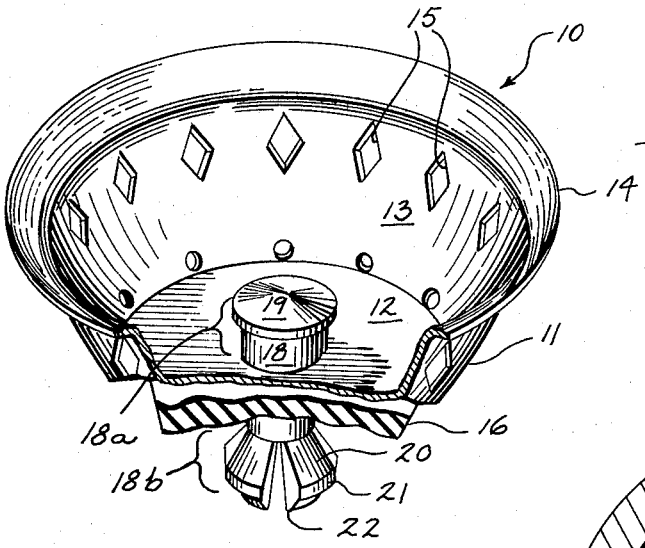
FIG. 1 is a perspective view of a preferred embodiment of the strainer basket and stopper assembly of the present invention.

Referring to the drawings, it can be seen that the strainer basket-stopper assembly, generally identified by the number 10, includes a cup-shaped basket 11 with a base 12, an upstanding wall 13 and an outwardly extending rim 14. The wall includes perforations 15 which are sized to retain solid materials of a desired size within the basket 11 and to permit water and smaller sized particles to escape.

Figure 3:
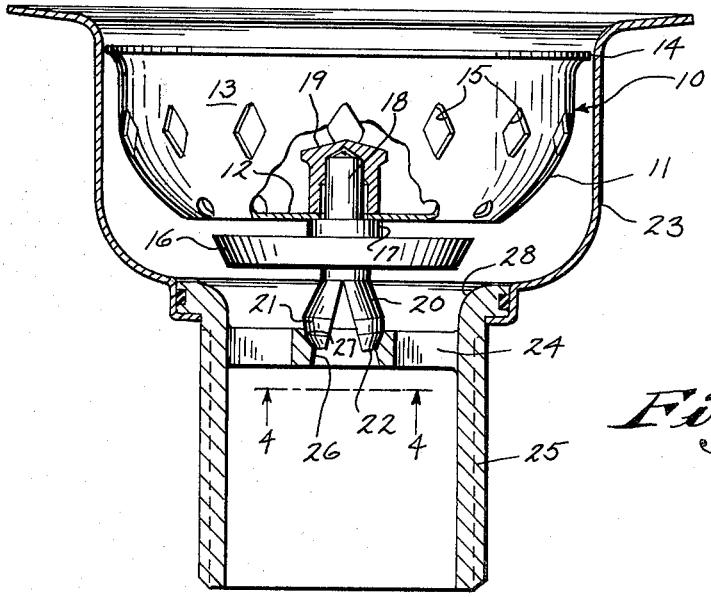
FIG. 3 is a cross sectional view of the strainer-stopper assembly of FIG. 1 in the open drain position in the sink drain.

As seen in FIGS. 1, 3 and 5, a stopper 16 of a rubber-like material is attached under the strainer basket 11. The stopper 16, as seen only in FIGS. 3 and 5, is spaced from the underside of the basket 11 by a spacer 17. Extending axially through the strainer basket 11, the spacer 17 and the stopper 16 is a stem 18. A handle portion 18*a* of the stem 18 extends above the base 12 of the basket 11 and a forked portion 18*b* extends below the stopper 16. The handle portion 18*a* of the stem 18 extends above the base of the basket and is enlarged as at 19 to provide an easy gripping surface. The forked portion 18*b* of the stem 18, as seen best in FIGS. 3 to 6, has four resilient legs or tines 20. The tines 20 are arcuate and taper outwardly from the point of attachment to an apex 21 and then taper inwardly to a generally flat tip 22 (see best in FIGS. 3 and 5). The function of the uniquely shaped tines 20 will be described in connection with the description of the operation of the basket strainer-stopper assembly 10 which follows.

Figure 2:
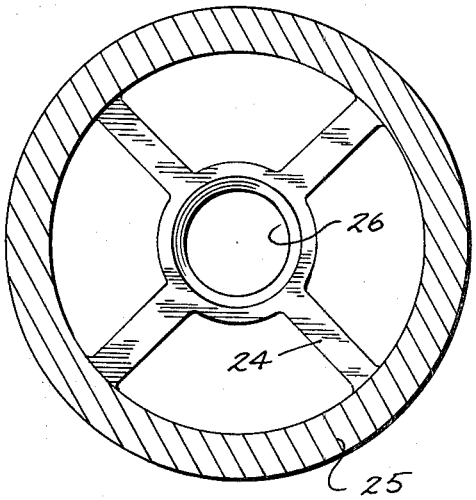
FIG. 2 is a plan view showing a drain plate for use with the assembly of the present invention.

The preferred basket strainer-stopper assembly 10 which has been described is intended for use with a drain 23 equipped with a drain plate 24 seen in FIGS. 2, 3 and 5. The drain plate 24 which extends across the lumen of the drain pipe 25 is provided with a central detent opening 26. As seen in FIGS. 2, 3 and 4, the edge of the plate 24 which forms the detent opening 26 is beveled as at 27.

In the drain open position, the strainer basket stopper assembly 10 is positioned as seen in FIG. 3 with the tips 22 of the tines 20 resting on the beveled edge 27 of the detent opening 26 in the drain plate 24. In this position, the stopper 16 is suspended above the drain pipe mouth 28 and water can flow out of the sink by passing through the perforations 15 in the basket strainer 11 about the stopper 16 and down the drain. Any solid particles which are larger than the perforations 15 in the basket strainer 11 will be retained therein.

When it is desired to close the drain, it is only necessary to push downwardly on the handle portion 18*a* of the stem 18 with sufficient force to spring the tines 20 inwardly toward each other enough to reduce the effective outer diameter of the tines as measured about the apexes 21 and to permit them to pass through the detent opening 26. When that occurs, the stopper 16 is seated in sealing relationship about the drain mouth 28 preventing the flow of water out of the sink. The tines 20 having passed through the detent opening 26 are no longer compressed and expand to their normal position to retain the assembly 10 in position.

To reopen the drain, the handle is pulled upwardly to again compress the tines 20 sufficiently inwardly so that they will pass through the detent opening 26.

The entire strainer basket-stopper assembly of the present invention moves from the open to the closed position so that the user can tell at a glance from the relative position of the assembly if the drain is open or closed.

The strainer basket-stopper assembly of the present invention is preferably assembled by aligning the basket 11, the spacer 17 and the stopper 16 and then inserting the shank of the lower forked portion 18*b* of the stem 18 axially through the aligned openings (not shown). The handle portion 18*a* of the stem 18 is then spin welded, glued or otherwise attached to the shank of the forked portion 18*b* to complete the assembly.

From the foregoing description, it will be readily apparent that the strainer basket-stopper assembly of the present invention is a simple, inexpensive device with a minimum of movable parts. Preferably, the stem 18 including the handle 18*a*, the forked portion 18*b* and the tines 20 are made of resilient plastic material such as nylon which is resistant to soap, detergents and hot water, and which is self-lubricating. The basket strainer 11 is preferably made of stainless steel and the stopper 16 of natural rubber or a rubber-like material. Other materials which are resistant to attack by the fluids and materials normally contacted in a sink and which can function in a satisfactory manner can also be used, if desired.

The strainer-stopper assembly of the present invention because of its plurality of legs is more stable in the open position than prior art devices having a single guide pin or leg. Furthermore, because it has no moving parts it is inexpensive, trouble free and easy to clean.

While for purposes of illustration a specific embodiment of the invention has been described, it will be readily apparent that a number of variations can be made without departing from the spirit and scope of the present invention. For example, alternative embodiments having three or more tines could be employed. Furthermore, the tines and the opening in the drain pipe could be differently shaped, if desired. Therefore, it is intended that the invention not be limited except by the claims which follow.

I claim:

1. In a basket strainer-stopper assembly for closing the drain opening of a sink having a drain plate with a central opening extending across the drain opening, which basket strainer-stopper assembly comprises a cup-shaped basket strainer, a stopper for closing the drain opening positioned below the basket strainer and the means which hold the assembly in an open drain position and cooperate with the opening in the drain plate to retain the assembly in a closed drain position, the improved means which comprise a stem extending axially through the basket strainer and the stopper, said stem having an upper portion projecting into the basket strainer to provide a handle and a lower forked portion having a plurality of individual arcuate legs which are connected at one end to the stem and have tips at the other end that support the assembly in a stable position upon the drain plate about the central opening when the assembly is in an open drain position, said arcuate legs being sufficiently resilient so that when a downward force is exerted on the upper portion of the stem the legs will flex inwardly sufficiently to pass through the central opening in the drain plate so that the assembly can assume a closed drain position and so that the legs also will flex inwardly when the upper portion of the stem is pulled upwardly so that the assembly can be moved from the closed drain position to an open drain position.

2. The basket strainer-stopper assembly of claim 1 in which the stem has four individual legs.

3. The basket strainer-stopper assembly of claim 1 in which the forked portion of the stem is of a resilient plastic material.

* * * * *